United States Patent [19]

Bailey et al.

[11] Patent Number: 5,048,621

[45] Date of Patent: Sep. 17, 1991

[54] ADJUSTABLE BENT HOUSING FOR CONTROLLED DIRECTIONAL DRILLING

[75] Inventors: Thomas F. Bailey; John E. Campbell, both of Houston, Tex.

[73] Assignee: MASX Energy Services Group, Inc., Houston, Tex.

[21] Appl. No.: 566,190

[22] Filed: Aug. 10, 1990

[51] Int. Cl.[5] ..... E21B 7/08

[52] U.S. Cl. ..... 175/74; 175/256; 175/320

[58] Field of Search ..... 175/74, 73, 320, 256, 175/107

[56] References Cited

U.S. PATENT DOCUMENTS

| | | | |
|---|---|---|---|
| 2,336,333 | 12/1943 | Zublin . | |
| 3,190,374 | 6/1975 | Caperan et al. | 175/74 |
| 3,586,116 | 6/1971 | Tiraspolsky et al. | 175/74 |
| 3,627,356 | 12/1971 | Anderson | 175/61 X |
| 3,667,556 | 6/1972 | Henderson | 175/73 |
| 3,717,208 | 2/1973 | Anderson | 175/74 |
| 4,067,404 | 1/1978 | Crase | 175/75 |
| 4,076,084 | 2/1978 | Tighe | 175/73 |
| 4,077,657 | 3/1978 | Trzeciak | 175/74 X |
| 4,220,214 | 9/1980 | Benoit | 175/61 |
| 4,240,512 | 12/1980 | Haglund | 175/75 |
| 4,286,676 | 9/1981 | Nhuyen et al. | 175/74 |
| 4,303,135 | 12/1981 | Benoit | 175/73 |
| 4,522,272 | 6/1985 | Beimgraben | 175/74 |
| 4,655,289 | 4/1987 | Schoeffler | 166/820 |
| 4,694,914 | 9/1987 | Obrecht | 175/74 X |
| 4,745,982 | 5/1988 | Wenzel | 175/74 |
| 4,813,497 | 3/1989 | Wenzel | 175/74 |
| 4,884,643 | 12/1989 | Wawrzynowski et al. | 175/74 |

*Primary Examiner*—Hoang C. Dang

*Attorney, Agent, or Firm*—Edgar A. Zarins; Malcolm L. Sutherland

[57] ABSTRACT

An adjustable bent housing for controlled directional drilling of well holes. The bend angle of the housing can be conveniently adjusted upon release of the locking nut which is threadably mounted to the motor casing. The locking nut engages an adjusting ring having splines to lockingly engage both the motor casing and the adjustment sub. The adjustment sub and motor casing are lockingly engaged against axial displacement by threads and a plurality of locking balls. An end portion of the outer surface of the motor casing and an end portion of the inner surface of the sub have an angle offset from the central axis to allow angle adjustment. The adjusting ring and locking nut are mounted to the coaxial portions of the components to simplify machining and ensure a clean locking engagement. Adjustment of the bend angle is accomplished by loosening the locking nut to disengage the adjusting ring and allow rotation of the motor casing relative to the universal housing sub.

12 Claims, 3 Drawing Sheets

ADJUSTABLE BENT HOUSING FOR CONTROLLED DIRECTIONAL DRILLING

BACKGROUND OF THE INVENTION

I. Field of the Invention

This invention relates to a bent housing used in directional drilling and, in particular, to an adjustable bent housing used in conjunction with a drill motor having a deviation angle which can be selectively adjusted to offset the angle of drilling.

II. Description of the Prior Art

Deviated and horizontal drilling has become increasingly important in geological drilling operations in order to effectively reach petroleum deposits which may be inaccessible with a simple vertical bore. Directional drilling may also become necessary to adjust a borehole which has strayed from the desired course. Many devices are available which facilitate directional drilling. The simplest is a bent sub which is inserted in the drill string between the drill bit and the downhole drilling motor in order to offset the longitudinal axis of the drill bit. Depending upon the desired angle of offset, a different bent sub is inserted into the drill string. In such a situation, it is necessary to raise the complete drill column out of the hole to replace the sub in order to make any angle corrections. More recently, adjustable subs have been developed which eliminate the need to replace the sub. Upon removal of the drill string, the angle of the sub is quickly adjusted without disassembly.

The use of bent subs requires that the downhole motor rotate the drill string to perform the drilling operations. More recent developments has found it advantageous to drive the drill bit using a drive shaft which passes axially through a housing forming a part of the drill string. Bent housings have also been developed which allow passage of the motor drive shaft through to the bit box. However, as with the bent subs, the use of bent housings required removal and replacement in the event a different deviation angle was necessary. Such replacement was considerably more complicated because of the drive shaft which extends through the housing. Thus, the need for an adjustable bent housing which allows simple adjustment of the angle of the drill string is considerably greater.

SUMMARY OF THE PRESENT INVENTION

The present invention overcomes the disadvantages of the prior known directional drilling devices by providing an adjustable bent housing whose angle can be simply and quickly adjusted to minimize downtime.

The adjustable bent housing of the present invention includes a motor casing having an axial passageway and an outer surface with a first portion coaxial with the inner passageway and a second portion having an angle offset from the axis of the sub, and means for locking the motor casing to the adjustment sub in order to maintain the relative angles therebetween. The axial passageway of the housing is designed to accommodate a drive shaft of the motor which incorporates at least one universal joint. In a preferred embodiment, the coaxial first portion of the outer casing surface and the inner surface of the sub include splines which cooperate with an adjusting ring having corresponding splines. The adjusting ring is selectively maintained in engagement with the splines of the sub and casing by a locking nut threadably mounted to the casing. A set screw is utilized to prevent rotation of the locking nut on the casing. Means are also provided to prevent axial separation of the casing from the sub particularly during adjustment of the relative angle. A plurality of retaining balls positioned between the components allow relative rotation but prevent axial displacement. The retaining balls are positionally captured within a circumferential reservoir.

Adjustment of the casing relative to the sub will produce different angle for the desired directional drilling. The locking nut is first loosened to allow the adjusting ring to disengage the splines of the sub allowing rotation of the casing relative to the sub. The deviation angle is created by the offset angles of the second outer surface portion of the casing and the second inner surface portion of the sub. Once the desired angle is obtained, the adjusting ring is re-engaged with the splines of the sub and locked down using the locking nut.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
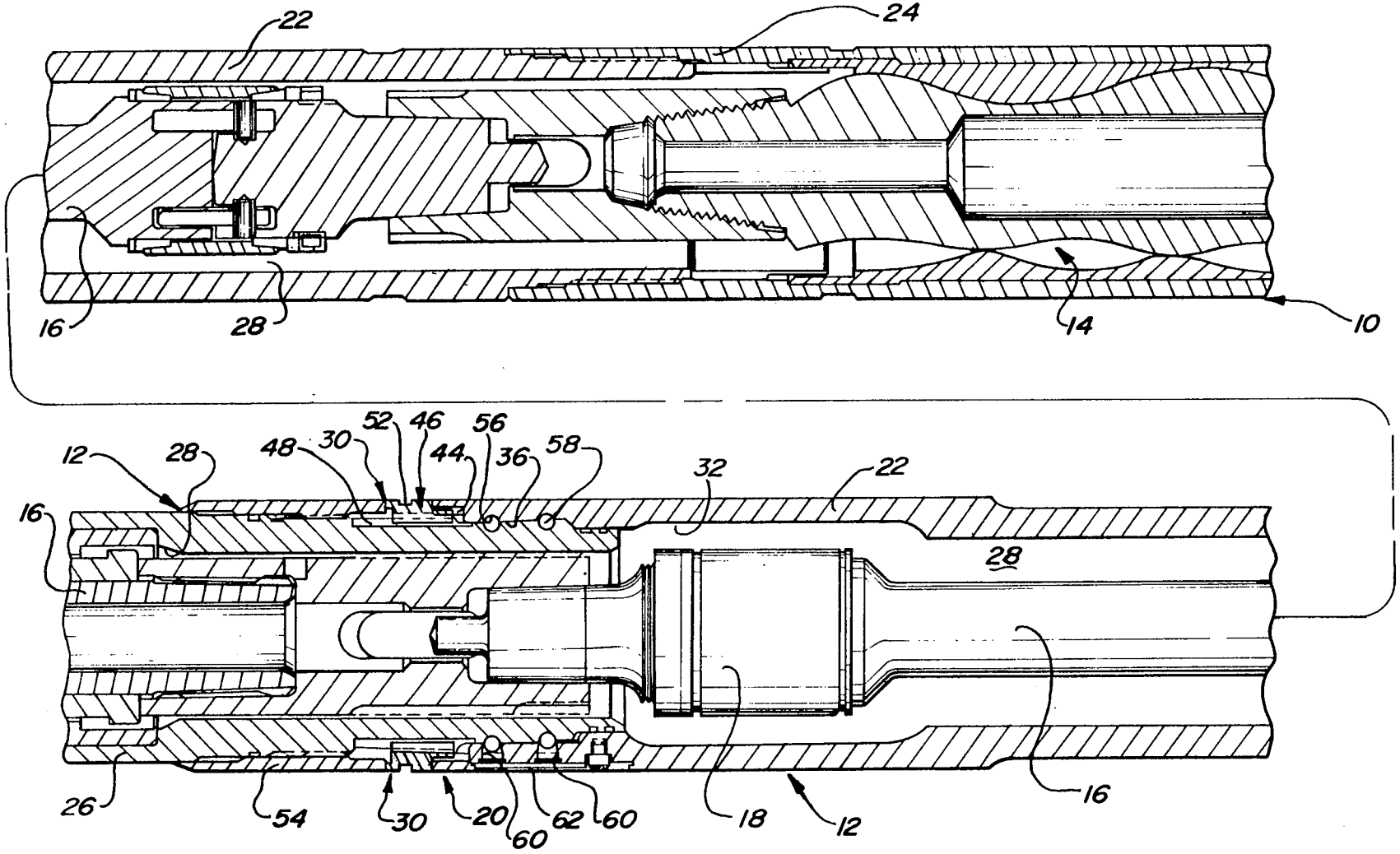
FIG. 1 is a cross-sectional perspective of the adjustable bent housing of the present invention having a drill motor drive shaft extending therethrough.

Referring first to FIG. 1, there is shown a section of a drill string 10 used in directional drilling applications and embodying the adjustable bent housing 12 of the present invention. In a preferred embodiment, the adjustable bent housing 12 of the present invention has a downhole drilling motor 14 extending therethrough including a drive shaft 16 drivably connected to a bit box (not shown) at the downhole end of the string 10. In order to accommodate the potential bend in the housing 12, the drive shaft 16 is provided with a universal joint 18 or other means for adjusting the angle of the drive shaft 16. Thus, torque is transmitted from the power section of the motor 14 through the drive shaft 16 to the bit box in order to drive the drill bit. In a well known manner, the entire drill string 10 and the motor 14 can be worked for more efficient horizontal drilling. When directional drilling is required, the angle of the housing 12 is adjusted as will be described hereinafter and the drill motor 14 alone is used to drive the drill bit resulting in a well bore in accordance with the bend angle of the housing 12. Although the present invention is being described in conjunction with an adjustable bent housing 12 which accommodates a drive shaft 16, it is to be understood that the same principles can be applied to an adjustable bent sub having only a central fluid passageway.

Referring now to FIGS. 1 through 5 which illustrate the adjustable bent housing 12 of the present invention in greater detail, the housing 12 generally comprises an adjustment assembly 20 used to selectively vary the bend angle of the housing 12 and therefore the direction of drilling. The housing 12 includes an upper sub 22 which is connected to the motor housing 24 and a lower casing 26 connected to the bit box. The upper sub 22 and the lower casing 26 have a central passageway 28 through which the drive shaft 16 extends. In a preferred embodiment, the lower casing 26 is matingly and rotatably received within the upper sub 22 to vary the bend angle therebetween. An interlock assembly 30 connects the upper sub 22 to the lower casing 26 to prevent rotation of one relative to the other once the desired angle of the housing 12 is set.

Figure 3:
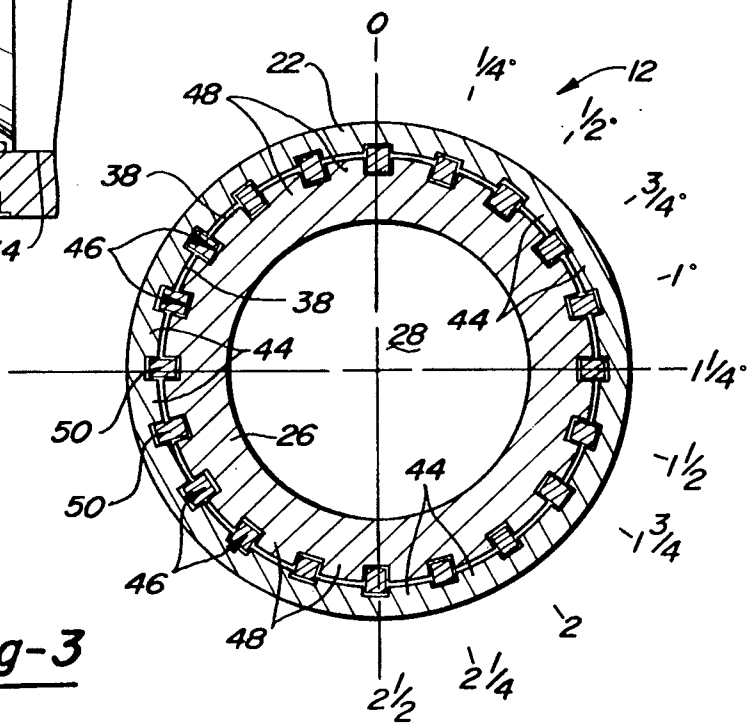
FIG. 3 is a cross-sectional view of the adjustable bent housing taken along lines 3—3 of FIG. 2.
Figure 2:
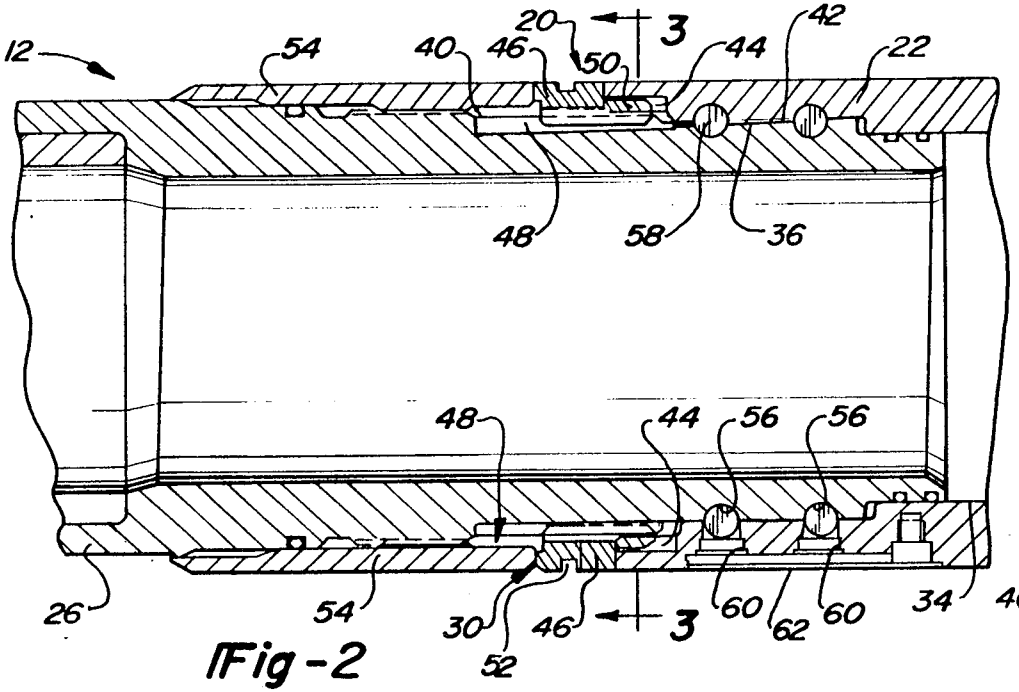
FIG. 2 is a cross-sectional perspective of the adjustable bent housing of the present invention.
Figures 4, 5:
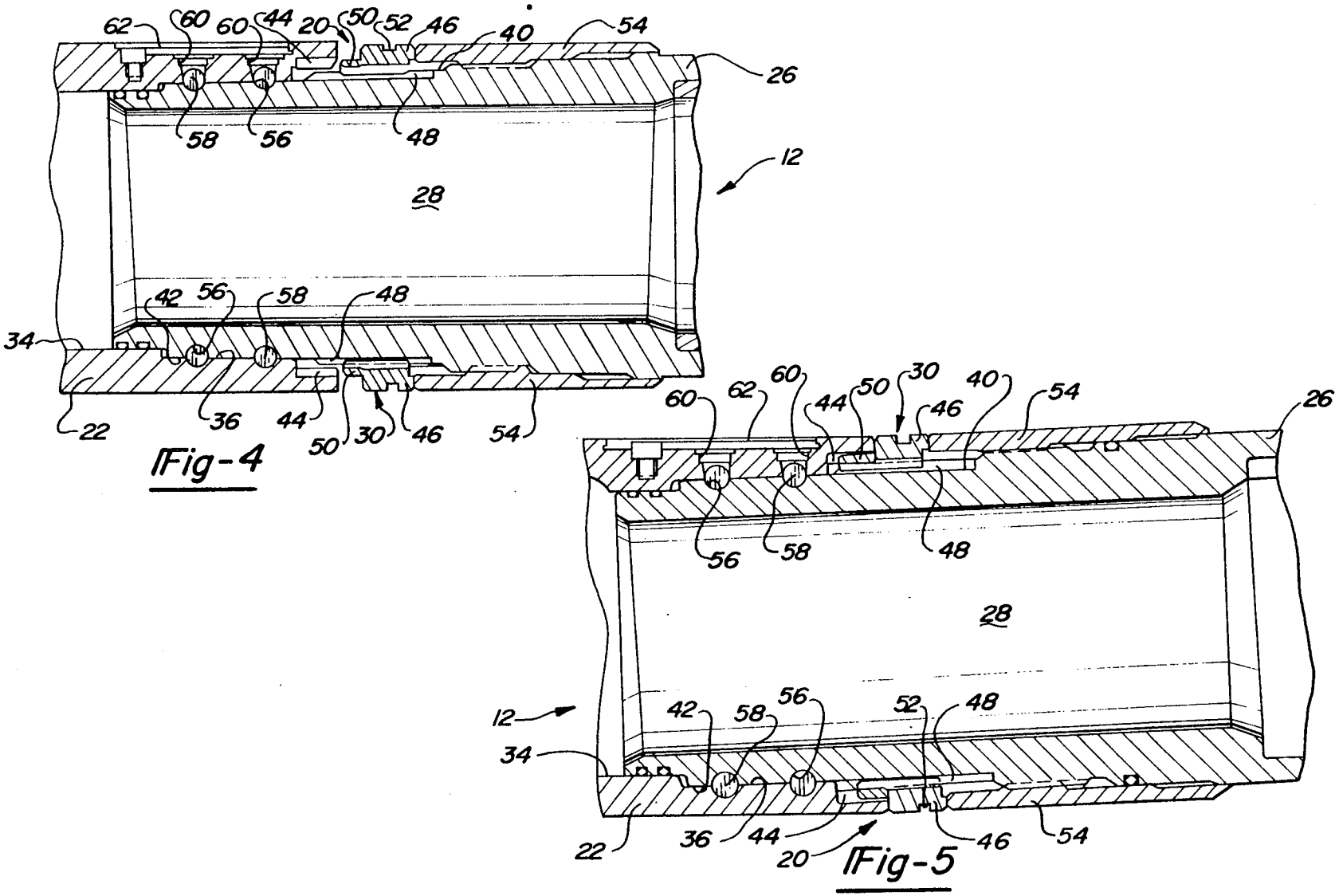
FIG. 4 is a cross-sectional view of the adjustable bent housing with the locking means released for relative adjustment of the housing.
FIG. 5 is a cross-sectional view of the adjustable bent housing with the angle of the housing offset for directional drilling.

Reference is now made to FIGS. 2 through 5 which show the adjustment assembly 20 in greater detail. The upper sub 22 has a substantially cylindrical inner surface 32 including a first portion 34 coaxial with the longitudinal axis of the housing 12 and a second portion 36 having an axis through which is offset from the longitudinal axis by a predetermined angle. Upon assembly of the upper sub 22 and lower casing 26, the second portions 36 and 42 of the upper sub 22 and lower casing 26, respectively, will matingly engage thereby determining the angle of the lower casing 26 relative to the upper sub 22. When the second surface portions 36 and 42 are mated so as to cancel their respective offset angles, the housing 12 has a straight configuration as shown in FIG. 2. Conversely, if the lower casing 26 is rotated relative to the upper sub 22 such that the offset angles of the second portions 36 and 42 are in the same plane and direction the maximum bend angle is obtained as shown in FIG. 5. In a preferred embodiment of the present invention, the lower casing 26 can be incrementally adjusted relative to the upper sub 22 to create bend angles of up to 2½ degrees. Of course, depending upon the offset angles of the second portions 36 and 42 this maximum bend can be varied although it has been determined that the 2½ degree bend is sufficient for most directional drilling operations.

In order to prevent rotation of the lower casing 26 relative to the upper sub 22 the interlock assembly 20 drivably connects the sections of the bend housing 12. Formed proximate the downhole end of the upper sub 22 are a plurality of radially inwardly disposed splines 44 circumferentially spaced along the inner surface 32. These inwardly disposed splines 44 selectively cooperate with an adjusting ring 46 slidably mounted to the lower casing 26. The adjusting ring 46 is slidably mounted to outwardly disposed splines 48 formed on the first portion 40 of the cylindrical outer surface 38 of the lower casing 26. The splines 48 of the lower casing 26 are of sufficient length to allow the adjusting ring 46 to be fully retracted from the splines 44 of upper sub 22. Thus, upon engagement, the adjusting ring 46 locks the components against relative rotation. However, upon retraction of the adjusting ring 46 the lower casing 26 can be rotated relative to the upper sub to adjust the bend angle of the housing 12. Once the desired angle is obtained the adjusting ring 46 is again slid into locking engagement with the upper sub 22 whereby the spline teeth 50 of the adjusting ring 46 engage the splines 44 of the upper sub 22 and the splines 48 of the lower casing 26. A notch or groove 52 in the outer surface of the adjusting ring 46 facilitates retraction from the upper sub 22 since a screwdriver or similar tool can be inserted therein to move the ring 46 along the splines 48. The splines 48 are formed in the first concentric portion 40 of the lower casing 26, and therefore the adjusting ring 46 is mounted to the first portion 40, in order to ensure smooth engagement and retraction of the adjusting ring 46. Such placement also reduced machining costs since the offset second portion 42 is above the splines 48 thereby minimizing the portion of the outer surface 38 which requires the offset machining.

A locking nut 54 is threadably mounted to the first concentric portion 40 of lower casing outer surface 38 to selectively secure the adjusting ring 46 in the engaged position. The locking nut 54 abuts against the adjusting ring 46 to prevent the ring 46 from travelling along the splines 48 thereby maintaining locking engagement with splines 44 of the upper sub 22. Rotation of the locking nut 54 as to allow retraction of the adjusting ring 46 will allow adjustment of the bend angle of the housing 12. A set screw may be provided in the locking nut 54 to prevent inadvertent rotation and retraction which could result in separation of the housing sections.

Although the interlock assembly 30 secures the lower casing 26 and upper sub 22 against relative rotation axial separation would not be prevented. To prevent axial displacement, at least one annular groove 56 is formed between the outer surface 36 of lower casing 26 and the inner surface 42 of the upper sub 22. Locking bearings 58 positioned within the groove 56 prevent relative axial displacement of the sub 22 and casing 26. In a preferred embodiment of the present invention, a pair of annular grooves 56 are formed in the surfaces 42 and 36 which are filled with locking bearings 58. The bearings 58 are positioned in the grooves 56 through ports 60 formed in the outer surface of the upper sub 22. The bearings 58 are maintained within the grooves 56 by a removable retainer member 62 slidably received in the outer surface of the upper sub 22. Thus, in the event the housing 12 must be disassembled, the bearings 58 can be removed from the grooves 56 to permit disconnection of the lower casing 26 from the upper sub 22.

Operation of the adjustable bent housing 12 allows the directional drilling to be precisely controlled without substitution of the housing. During vertical drilling the upper sub 22 and lower casing 26 are disposed along the same axis so that there is no bend in the housing 12. Accordingly, if the full drill string or the drilling motor is operated the drill bit will travel in substantially a straight line. In the event a course correction for the drilling or a deviated well bore is necessary, the drill string can be tripped from the hole to adjust the bend angle of the housing. Unlike some prior known bent housings, the adjustable bent housing of the present invention does not need to be replaced or disassembled to vary the bend angle. At the surface, the locking nut 54 is loosened along the lower casing 26 to permit retraction of the adjusting ring 46 from the splines 44 of the upper sub 22. While the locking bearings 58 prevent retraction of the lower casing 26 from mating engagement with the upper sub 22, the casing 26 can be rotated relative thereto to vary the bend angle. As the lower casing 26 is rotated the offset second portion 42 of the outer surface 36 thereof will cooperate with the offset second portion 42 of the upper sub 22 to change the bend angle. As is shown in FIG. 3, the relative positions of the components can be incrementally varied to change the bend angle in ¼ degree increments between zero degrees and 2½ degrees. Greater variations can be achieved by varying the offset angle of the second portions 36 and 42 or by increasing the number of splines to vary the incremental relative positions of the upper sub 22 and lower casing 26.

Once the desired bend angle has been set, the adjusting ring 46 is re-engaged with the splines 44 of the upper sub 22 to lock the sub 22 against rotation relative to the lower casing 26. As the locking nut 54 is tightened against the adjusting ring 46, the ring 46 will be prevented from retracting from the inwardly disposed splines 44 of the upper sub 22. Thus, the present invention provides a convenient mechanism for adjusting the bend angle of the housing 12 used in directional drilling.

The foregoing detailed description has been given for clearness of understanding only and no unnecessary limitations should be understood therefrom as some modifications will be obvious to those skilled in the art without departing from the scope and spirit of the appended claims:

What is claimed is:

1. A downhole adjustable bent housing for use in directional drilling, said adjustable bent housing comprising:

a first sub having a longitudinal axis and an internal cylindrical surface having an axis offset from said longitudinal axis by a predetermined angle, one end of said first sub having radially inwardly disposed splines;

a second sub having a longitudinal axis and an outer cylindrical surface, said outer cylindrical surface including a first portion and a second portion having an axis offset from said longitudinal axis of said second sub by a predetermined angle, said second sub matingly received within said first sub such that said second portion of said second sub matingly engages said internal surface of said first sub for angular adjustment of said housing, said first portion of said outer cylindrical surface including radially outwardly disposed splines;

an adjusting ring mounted to said first portion of said outer cylindrical surface of said second sub, said adjusting ring having a plurality of splines for engagement with said splines of said second sub and to selectively engage said inwardly disposed splines of said first sub, said adjusting ring axially movable along said splines of said second sub between an engaged position wherein said adjusting ring engages said splines of said first sub to nonrotatably couple said first sub and said second sub and a disengaged position wherein said adjusting ring is disconnected from said splines of said first sub such that angular adjustment of said second sub relative to said first sub is permitted to adjust the bend angle of said housing; and means for selectively securing said adjusting ring in said engaged position adjustably mounted to said first portion of said second sub outer cylindrical surface.

2. The adjustable bent housing as defined in claim 1 and further comprising locking means for preventing axial displacement of said second sub relative to said first sub, said locking means including a plurality of locking bearings positionally captured between said inner surface of said first sub and said outer surface of said second sub.

3. The adjustable bent housing as defined in claim 1 wherein said securing means comprises a locking nut threadably mounted to said first portion of said second sub outer cylindrical surface such that rotation in a first direction will allow disengagement of said adjusting ring.

4. The adjustable bent housing as defined in claim 1 wherein said first sub and said second sub include a central passageway for receiving a drive shaft of a drilling motor therethrough.

5. A downhole adjustable bent housing for use in directional drilling, said adjustable bent housing comprising:

an upper sub having a longitudinal axis and an internal cylindrical surface, said internal cylindrical surface including a first portion substantially coaxial with said longitudinal axis and a second portion having an axis offset from said longitudinal axis by a predetermined angle, said upper sub including radially inwardly disposed splines formed proximate the lower end of said upper sub;

a lower casing having a longitudinal axis and an outer cylindrical surface, said outer cylindrical surface including a first portion substantially coaxial with said longitudinal axis and a second portion having an axis offset from said longitudinal axis by a predetermined angle, said lower casing matingly and rotatably received within said upper sub such that said second portion of said lower casing matingly engages said second portion of said upper sub for angular adjustment of said housing;

locking means for preventing axial displacement of said lower casing relative to said upper sub;

an adjusting ring mounted to said first portion of said outer cylindrical surface of said lower casing, said adjusting ring having a plurality of splines to selectively engage said inwardly disposed splines of said upper sub, said adjusting ring cooperating with and movable along radially outwardly disposed splines formed in said first outer cylindrical surface between an engaged position wherein said adjusting ring engages said splines of said upper sub to nonrotatably couple said upper sub and lower casing and a disengaged position wherein said adjusting ring is disconnected from said upper sub splines such that angular adjustment of said lower casing relative to said upper sub is permitted to adjust the bend angle of said housing; and a locking nut for selectively securing said adjusting ring in said engaged position, said locking nut adjustable mounted to said first portion of said lower casing outer cylindrical surface.

6. The adjustable bent housing as defined in claim 5 wherein said locking means comprises a plurality of locking bearings positionally captured within an annular groove formed between said inner surface of said upper sub and said outer surface of said lower casing, said locking bearings within said annular groove preventing axial displacement of said lower casing relative said upper sub.

7. The adjustable bent housing as defined in claim 6 wherein said locking bearings are maintained in said annular groove by a selectively removable retainer member.

8. The adjustable bent housing as defined in claim 5 wherein said locking nut is threadably mounted to said lower casing for selectively securing said adjusting ring in said engaged position.

9. The adjustable bent housing as defined in claim 5 wherein said upper sub and said lower casing include a central passageway for receiving a drive shaft of a drilling motor therethrough.

10. An adjustable bent housing for use in directional drilling in connection with a downhole drilling motor, said housing having a drive shaft of the drilling motor extending therethrough for operating a drilling bit, said adjustable bent housing comprising:

an upper sub having a longitudinal axis and an internal cylindrical surface, said internal cylindrical surface including a first portion substantially coaxial with said longitudinal axis and a second portion having an axis offset from said longitudinal axis by a predetermined angle, said upper sub including radially inwardly disposed splines formed proximate the lower end of said upper sub;

a lower casing having a longitudinal axis and an outer cylindrical surface, said outer cylindrical surface including a first portion substantially coaxial with said longitudinal axis and a second portion having an axis offset from said longitudinal axis by a predetermined angle, said lower casing matingly and rotatably received within said upper sub such that said offset second portion of said lower casing matingly engages said offset second portion of said upper sub for angular adjustment of said housing;

said upper sub and said lower casing including a central passageway through which the drive shaft of the drilling motor extends and at least one annular groove formed between said inner surface of said upper sub and said outer surface of said lower casing, said at least one annular groove receiving a plurality of locking bearings thereby preventing axial displacement of said lower casing relative to said upper sub and maintain mating engagement of said offset second portion of said upper sub and lower casing;

an adjusting ring slidably mounted to said first portion of said outer cylindrical surface of said lower casing, said adjusting ring having a plurality of splines to selectively engage said inwardly disposed splines of said upper sub, said adjusting ring cooperating with and movable along radially outwardly disposed splines formed in said first outer cylindrical surface of said lower casing between an engaged position wherein said adjusting ring engages said splines of said upper sub to nonrotatably couple said upper sub and lower casing and a disengaged position wherein said adjusting ring is disconnected from said upper sub splines such that angular adjustment of said lower casing relative to said upper sub is permitted to adjust the bend angle of said housing; and a locking nut for selectively securing said adjusting ring in said engaged position, said locking nut threadably mounted to said first portion of said lower casing outer cylindrical surface.

11. The adjustable bent housing as defined in claim 10 wherein said locking bearings are positionally captured within said at least one groove by a retainer member slidably mounted to said upper sub, said retainer member slidable to an open position for removal of said bearings from said at least one groove whereby said upper sub and lower casing may be axially disconnected.

12. The adjustable bent housing as defined in claim 11 wherein said upper sub and lower casing include a pair of spaced apart annular grooves formed therein, said slidable retainer member maintaining said locking bearings in both said annular grooves.

* * * * *